US006670761B1

(12) United States Patent
Lee et al.

(10) Patent No.: US 6,670,761 B1
(45) Date of Patent: Dec. 30, 2003

(54) MAGNETRON HAVING STRAPS OF DIFFERENT MATERIALS TO ENHANCE STRUCTURAL STABILITY

(75) Inventors: Yong Soo Lee, Kyonggi-do (KR); Jong Soo Lee, Kyonggi-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/658,004

(22) Filed: Sep. 8, 2000

(30) Foreign Application Priority Data

Sep. 22, 1999 (KR) ..... 1999-41006

(51) Int. Cl.[7] ..... H01J 23/22
(52) U.S. Cl. ..... 315/39.69; 315/39.51
(58) Field of Search ..... 315/39.69, 39.51

(56) References Cited

U.S. PATENT DOCUMENTS 2,871,407 A * 1/1959 Okress et al. ..... 315/39.69
4,714,859 A 12/1987 Clark ..... 315/39.67

FOREIGN PATENT DOCUMENTS

GB 2173636 * 10/1986 ..... 315/39.69
JP 56-8134 Y2 9/1976
JP 58-54771 Y2 7/1980
JP 4286839 * 10/1992 ..... 315/39.69

* cited by examiner

*Primary Examiner*—Benny T. Lee
(74) *Attorney, Agent, or Firm*—Birch, Stewart, Kolasch & Birch, LLP

(57) ABSTRACT

Magnetron including a plurality of anode vanes each having notches of shapes different from each other in a top and a bottom, ring formed outer straps of copper each in contact to every other one of the anode vanes in top and bottom notches thereof to connect the anode vanes for forming an electrostatic field to the anode vanes, and ring formed inner straps of a material having a heat resistance higher than the anode vanes of copper and a thermal expansion coefficient similar to the anode vanes each in contact to every other one of the anode vanes in top and bottom notches thereof other than the anode vanes the outer straps are not in contact in concentric with the outer straps on an inner side thereof, thereby preventing deformation and breakage of the straps in advance to allow application to a higher powered magnetron.

6 Claims, 4 Drawing Sheets

MAGNETRON HAVING STRAPS OF DIFFERENT MATERIALS TO ENHANCE STRUCTURAL STABILITY

BACKGROUND OF THE INVENTION

1. Field of the Invention

The present invention relates to a magnetron, and more particularly, to a strap in a magnetron.

2. Background of the Related Art

Referring to FIG. 1, a general magnetron is provided with a cylindrical anode. body 11, anode vanes 12 fitted to an inside wall of the anode body 11 in a radial direction, a resonant cavity (not shown) having straps 13 connected to the anode vanes 12 alteratively through two holes 12*a* and 12*b* in each of the anode vanes, a cathode 15 on a central portion of the magnetron having a helical filament 14 serving as a cathode 15, an antenna 16 fitted to one of the anode vanes 12, a plurality of cooling fins 17 fitted to an outer circumferential surface of the anode body, a yoke 18*a* and 18*b* divided into upper and lower plates for protecting the cooling fins and guiding external air into the cooling fins 17, permanent magnets 19 of N-S poles on top and bottom of the anode body 11 for forming static manetic fields, and a filter box 20 (See FIGS. 2A, 2B.)

The operation of the general magnetron will be explained.

Electrons emitted upon heating the filament 14 receive forces of the static electric field provided between the cathode and the resonant cavity and the static magnetic fields provided in up and down direction of the resonant cavity by the permanent magnets 19, to evolve into a cycloidal movement in an operation space between the cathode and the resonant cavity, when the electrons interact with a high frequency electric field already provided between the anode vanes 12, to move toward the resonant cavity gradually during which most of electron energy is converted into a high frequency energy. The high frequency energy is accumulated in the resonant cavity (not shown) and emitted to outside of the magnetron through an antenna 16. On the other hand, the energies, the electrons are holding, are converted into thermal energies in the resonant cavity. The heat generated at the anode vanes 12 is cooled down by the plurality of cooling fins 17 fitted to the outer circumferential surface of the anode body 11, thereby preventing deterioration of performance of the magnetron caused by the heat.

A first exemplary related art magnetron will be explained based on the foregoing general Referring to FIGS. 2A and 2B, the first exemplary related art magnetron is provided with two ring form of straps 13 of stainless steel, and a plurality of anode vanes 12 each having two holes 12*a* and 12*b* in up and down portions of central portions thereof with the straps 13 passed therethrough. Two pieces of the strap 13 will be called as a first strap and a second strap 13*a* and 13*b*, and the two holes 12*a* and 12*b* in each of the plurality of anode vanes 12 will be called as a first hole 12*a* for the smaller one and a second hole 12*b* for the larger one, which will be explained in more detail. The first strap 13*a* passes through the first hole 12*a* in the odd numbered anode vane 12 with contact thereto, and the second hole 12*b* in the even numbered anode vane without contact thereto according to an order of disposal of the plurality of anode vanes 12, to connect the plurality of the anode vanes 12 at fixed intervals. The second strap 13*b* passes through the first hole 12*a* in the even numbered anode vane 12 with contact thereto, and the second hole 12*b* in the odd numbered anode vane 12 without contact thereto according to an order of disposal of the plurality of anode vanes 12, to connect the plurality of the anode vanes 12 at fixed intervals. The first and second straps 13*a* and 13*b* are connected alternatively to odd numbered and even numbered anode vanes respectively, for forming different polarities between adjacent anode vanes 12, to form static electric fields.

However, the related art a magnetron has the following problems.

The straps 13(hereafter called as "center type strap") of stainless steel applied to the related art magnetron with a power higher than 1.7KW requires to pass through the anode vanes 12 disposed at fixed intervals one by one, that results in a significant amount of productivity loss. Moreover, the center type strap 13 is required to cut for inserting into the holes 12*a* and 12*b* in the anode vanes 13, and to weld the cut ends together once the insertion is completed, when, for good appearance sake, the welding is made at the first hole 12*a* in the anode vane 12 or the two cut ends are welded the same as an original state, which are inconvenient and complicated in fabrication. Therefore, a simple strapping method is in need, which can solve the foregoing fabrication problem to improve a productivity while characteristics of the strap and the magnetron are equal, or similar to the related art.

Referring to FIGS. 3A and 3B showing a second exemplary related art magnetron for a microwave oven of i KW, the second exemplary related art magnetron is provided with one pair of two ring formed straps 22 with different diameters(the greater diameter strap is called as "outer strap 22*b*", and the smaller diameter strap is called as "inner strap 22*a*") of oxygen free copper(hereafter called as "side type inner and outer straps"), and a plurality of anode vanes 21 each having a notch in top and bottom to form circular grooves in top and bottom of the plurality of anode vanes in overall such that every other anode vane 21 is in contact with the one of the outer strap 22*b* and the inner strap 22*a* for inducing a static electric field, which will be explained in detail. The notches in odd numbered anode vanes 21 and even numbered anode vanes 21 are formed to have different shapes(a first notch shape 21*a* and a second notch shape 21*b*), such that, with respect to the top side groove, the first notch. shape 21*a* for the odd numbered anode vane 21 is not come into contact with the inner strap 22*a*, but with the outer strap 22*b*, and the second notch shape 21*b* for the even numbered anode vane 21 is come into contact with the inner strap 22*a*, but not with the outer strap 22*b*. The notches in the bottom side have shapes opposite to the top side notches, such that fashion of contact of the inner strap and the outer strap to the odd number and even numbered anode vanes is opposite. Thus, the second exemplary related art strap requires neither the cutting of the strap, nor the insertion of the strap into the holes in the anode vanes, both of which are required in the first exemplary related art magnetron, to permit a high productivity and convenience in fabrication.

However, if a high voltage is applied to the magnetron with the second exemplary related art magnetron for providing a power higher than 1.7KW will cause the following problems. That is, in general, the magnetron has an efficiency of 70% to waste about 30% as heat such that the higher the power of the magnetron, the greater the heat loss wasted at the anode, to cause a problem in securing a thermal stability of the high powered magnetron, particularly, the resonant cavity is subjected to a high thermal stress, of which the most intense part is the very side type inner and outer straps 22, because the inner and outer straps 22 are next to the thermal electrons emitted from the cathode, directly affected by the cycloidal movement of the thermal electrons, and formed of oxygen free copper.

Though the oxygen free copper is used widely owing to its good thermal conductivity, the material is liable to deformation and has a weak strength, such that, if the material is subjected to a relatively high thermal stress, the material is deformed, and the side type strap 22 is broken as fatigue is accumulated from prolonged use. That is, though a stable lifetime of the inner and outer strap 22 of oxygen free copper can be secured within a usual power range of the microwave oven magnetron, it is impossible to apply the inner and outer strap 22 of oxygen free copper to a magnetron having an average high frequency power exceeding 1.7KW.

SUMMARY OF THE INVENTION

Accordingly, the present invention is directed to a magnetron that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the magnetron includes a plurality of anode vanes each having notches of shapes different from each other in a top and a bottom, ring formed outer straps of copper each in contact to every other one of the anode vanes in top and bottom notches thereof to connect the anode vanes for forming an electrostatic field to the anode vanes, and ring formed inner straps of a material having a heat resistance higher than the anode vanes of copper and a thermal expansion coefficient similar to the anode vanes each in contact to every other one of the anode vanes in top and bottom notches thereof other than the anode vanes the outer straps are not in contact in concentric with the outer straps on an inner side thereof, thereby preventing deformation and breakage of the straps in advance to allow application to a higher powered magnetron.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explanation of the present invention, parts identical to the related arts will be given the same names and symbols, and explanations of which will be omitted.

Figure 3A:
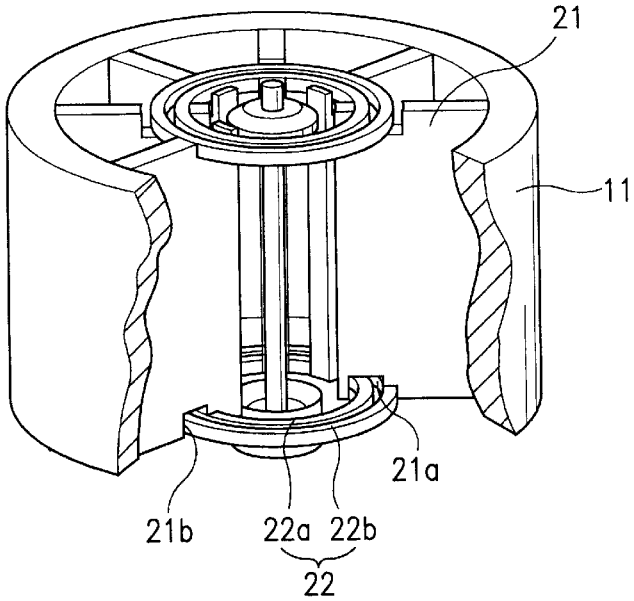
FIG.3A Related Art
FIG. 3A illustrates a perspective view of a second exemplary related art magnetron showing a side type strap fitted to anode vanes.
Figure 3B:
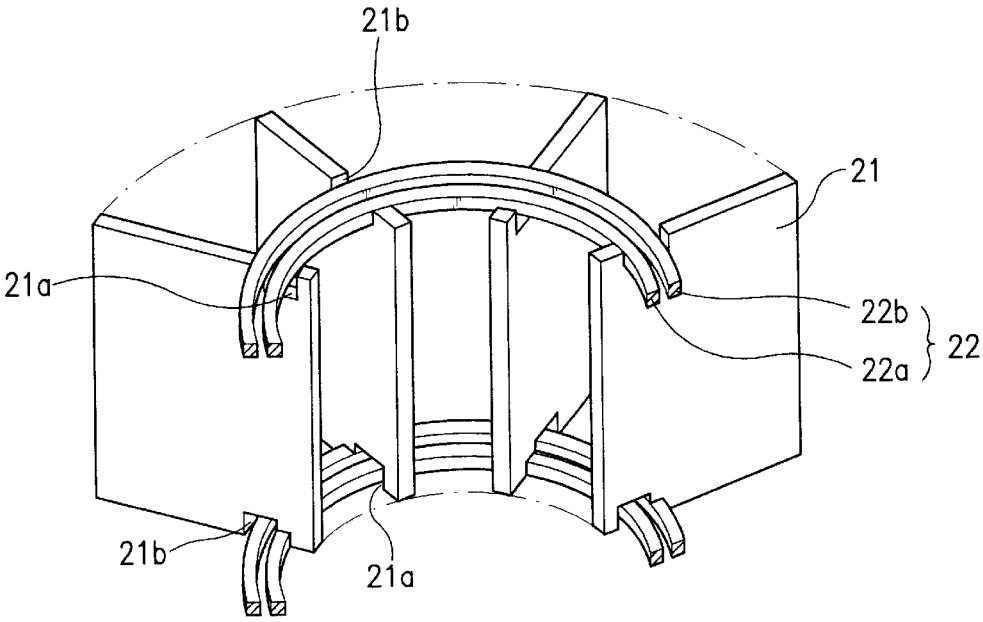
FIG.3B Related Art
FIG. 3B illustrates key parts of the second exemplary related art magnetron in FIG. 3A; and, FIG. 4 illustrates a graph showing a comparison of thermal structural stability for respective straps when a high voltage is applied to magnetrons of the first exemplary related art, the second exemplary related art and the present invention respectively so as to provide a power exceeding 1.7KW.

Referring to FIGS. 3A and 3B, the magnetron in accordance with a preferred embodiment of the present invention includes a plurality of anode vanes 21 each having notches 21*a* and 21*b* in top and bottom different to each other, ring formed outer straps 22*b* of copper each in contact to every other one of the anode vanes 21 in top and bottom notches thereof to connect the anode vanes for forming an electrostatic field, to the anode vanes 21, and ring formed inner straps 22*a* of a material having a strong heat resistance so as to be stronger than the anode vanes of copper and a thermal expansion coefficient similar to the anode vanes each in contact to every other one of the anode vanes 21 in top and bottom notches thereof other than the anode vanes 21 the outer straps 22*b* are not in contact in concentric with the outer straps 22*b* on an inner side thereof. It is preferable that the outer strap 22*b* is formed of oxygen free copper, and the inner strap 22*a* is formed of stainless steel.

Figure 1:
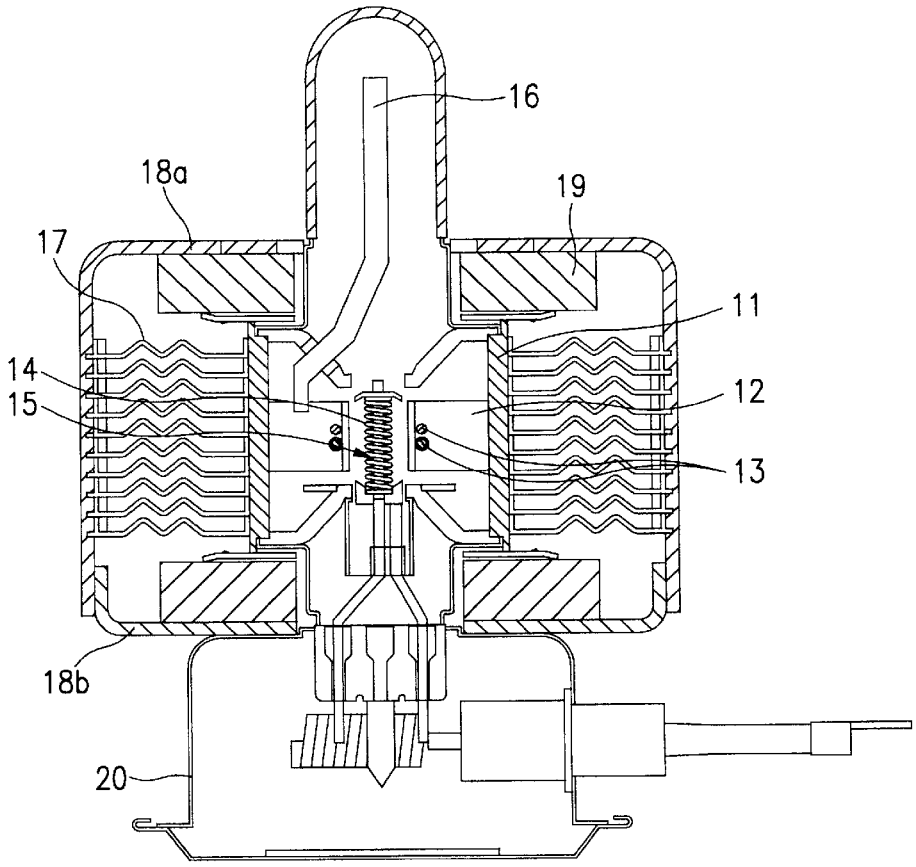
FIG.1 Related Art
FIG. 1 illustrates a section showing a first exemplary related art magnetron.
Figure 2A:
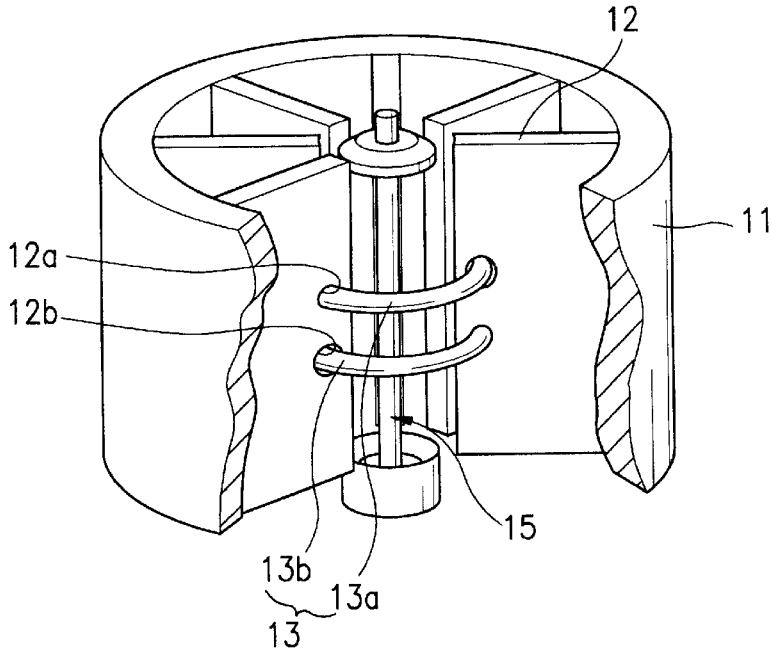
FIG.2A Related Art
FIG. 2A illustrates a perspective view of the first exemplary related art magnetron showing a center type strap inserted in anode vanes.
Figure 2B:
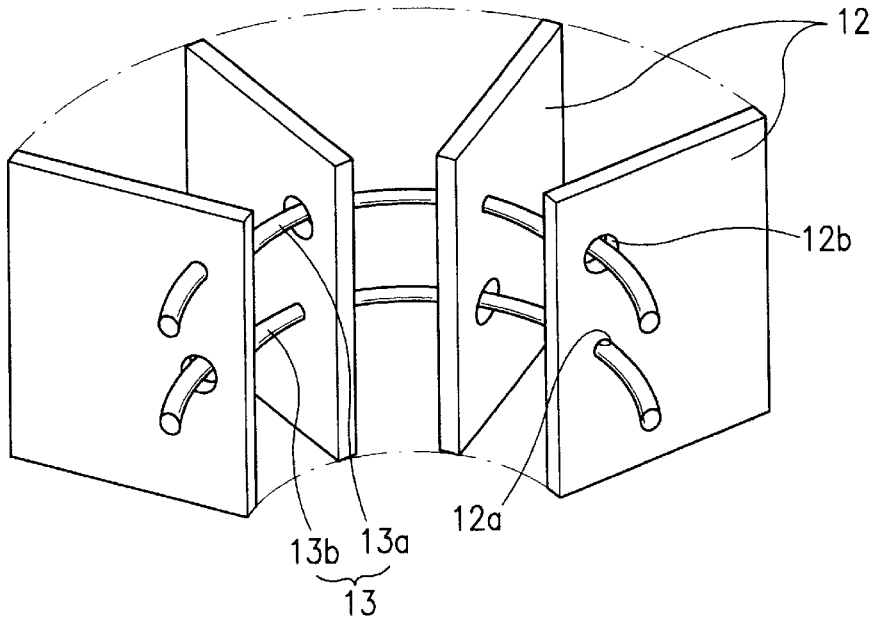
FIG.2B Related Art
FIG. 2B illustrates key parts of the first exemplary related art magnetron in FIG. 2A.
Figure 4:
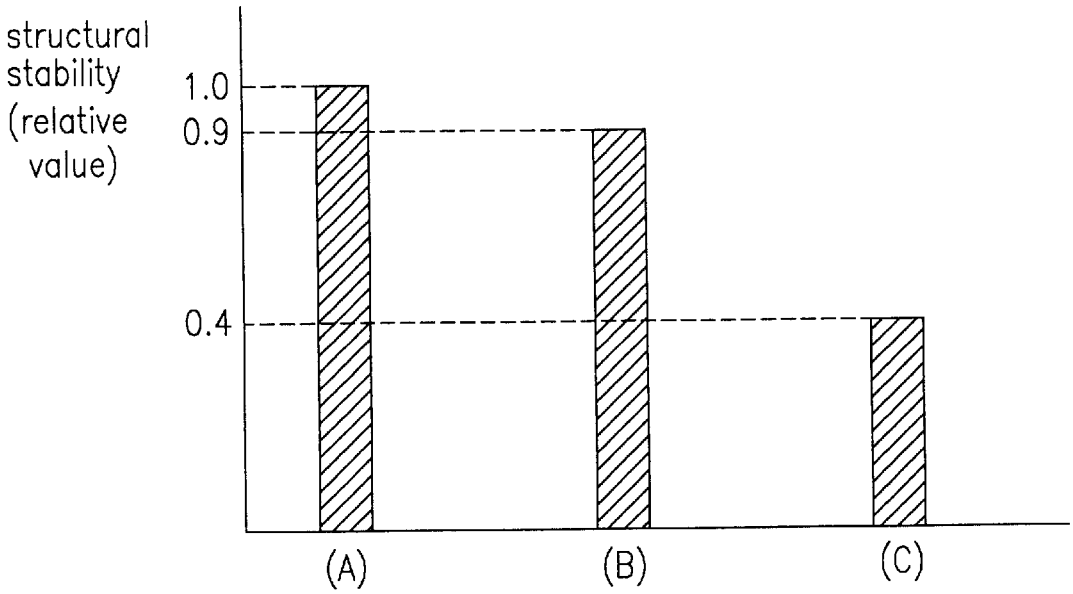

The magnetron of the present invention will be explained in more detail with reference to FIG. 4. FIG. 4 illustrates a graph showing a comparison of thermal structural stability for respective straps when a high voltage is applied to magnetrons of the first exemplary related art, the second exemplary related art and the present invention respectively so as to provide a power exceeding 1.7KW, wherein 'A' denotes a center type straps 13 of stainless steel for the upper and lower straps 13*a* and 13*b* in FIG. 2A in the first exemplary related art, 'B' denotes side type straps of the present invention having an inner strap 22*a* of stainless steel and an outer strap 22*b* of oxygen free copper, and 'C' denotes side type straps of the second exemplary related art having inner and outer straps 22*a* and 22*b* of oxygen free copper. The structural stability is a comparison of experimental values for, the 'A', 'B' and 'C', in which the closer to unity, the more stable the straps.

Referring to FIG. 4, though 'A' has a value close to unity (i.e. 1.0), as discussed in the first exemplary related art, the system has difficulty in assembly, and, therefore, is difficult to apply, and, as.'B' has a value (i.e. 0.9) close to 'A', 'B'; not only has a great structural stability, but also has a value (i.e. 0.4) is easy in assembly, and therefore, is easy to apply, since 'B' has the structure of the second exemplary related art magnetron. However, since the structural stability of 'C' is inferior to 'A' and 'B' substantially, it is difficult to apply 'C' to a high voltage magnetron. Eventually, the present invention suggests a magnetron having a side type inner and outer straps 22, identical with the second exemplary related art magnetron, except that the inner strap 22*a* is formed of stainless steel. The above will be explained, additionally. Though the side type inner and outer straps 22 of the second exemplary related art magnetron are easy to assemble, the inner strap 22*a* nearest to the cathode is the most vulnerable to a thermal stress caused by temperature variation because a substantial amount of thermal electrons are emitted from the cathode ('15' in FIG. 2A) and evolved into cycloidal movement if a high voltage is provided to the magnetron to provide an output greater than 1.7 kW. And, as a result of thermal stress test, it is found that the inner strap 22*a* is the most vulnerable to the thermal stress. Of course, the outer strap 22*b* is vulnerable to thermal stress, the outer strap 22*b* is stable compared to the inner strap 22*a*. Therefore, the inner strap 22*b* is formed of stainless steel which has a yield stress and a fatigue stress excellent than oxygen free copper. Though there are many materials which have strengths stronger than stainless steel, taking both a thermal expansion and strength into account, it is determined that the stainless steel has the best structural stability for a variation of temperature as results of various test. Because stainless steel has, not only excellent yield stress and fatigue stress, but also a thermal expansion coefficient which is similar to oxygen free copper used presently. That is, the stainless steel, not only has excellent yield stress and fatigue stress, to prevent permanent deformation or breakage caused by thermal stress coming from expansion or contraction following a temperature change, but also provides similar thermal expansion coefficients for the side type inner and outer straps 22, the anode vanes 21 and the anode body 11 (see FIG. 3A), that provides the following advantage. The similar thermal expansion coefficients of the side type inner and outer straps 22, anode vanes 21 and the anode body 11, which structurally restrict one another in the resonant cavity of the magnetron, prevents structural misalignment caused by repetitive expansion and contraction coming from thermal electrons emitted from the cathode in advance, that prevents cracking of the structure.

In the meantime, the outer strap 22*b* may also be formed of stainless steel because it is found from experiments that, if a high voltage is applied to a magnetron of high power over 1.7KW having both the inner strap 22*a* and the outer strap 22*b* formed of stainless steel, though there are structural misalignments caused among the structurally restricted different members, the amounts are very minute and the structure is very strong to thermal stress.

The magnetron of the present invention has the following advantages.

The stainless steel strap of the present invention with a high heat resistance can prevent permanent deformation and breakage coming from fatigue caused by repetitive temperature variation. And, the similar thermal expansion coefficients among members structurally restricted from one another can prevent occurrence of cracking caused by misalignment among the restricted members.

And, since the magnetron of the present invention can be applied to a magnetron of low power below 1KW, but to a magnetron of a high power over 1.7KW, the magnetron of the present invention has a wider application.

It will be apparent to those skilled in the art that various modifications and variations can be made in the magnetron of the present invention without departing from the spirit or scope of the invention. Thus, it is intended that the present invention cover the modifications and variations of this invention provided they come within the scope of the appended claims and their equivalents.

What is Claimed is:

1. A magnetron having an output of at least 1.7 kW, comprising:

a plurality of anode vanes of copper, each anode vane having notches of shapes different from each other in a top and a bottom;

ring-shaped outer straps of copper, each in contact to every other one of the anode vanes in top and bottom respective notches thereof to connect the anode vanes for forming an electrostatic field to the anode vanes; and ring shaped inner straps of a material having a heat resistance higher than the anode vanes of copper and a thermal expansion coefficient similar to the anode vanes each in contact to every other one of the anode vanes in top and bottom respective notches thereof, alternate vanes of the outer straps being different from the alternative vanes connected by the inner straps.

2. A magnetron as claimed in claim 1, wherein the copper is oxygen free copper.

3. A magnetron as claimed in claim 1, wherein the material is stainless steel.

4. A magnetron as claimed in claim 1, wherein the outer straps are comprised of oxygen free copper and the inner straps are comprised of stainless steel.

5. A magnetron as claimed in claim 1, wherein the notches in odd-numbered anode vanes and even-numbered anode vanes are formed to have different shapes so that a first notch shape for the odd-numbered anode vanes does not come into contact with the inner strap but does come into contact with the outer strap, and a second notch shape for the even-numbered anode vanes comes into contact with the inner strap but does not come into contact with the outer strap.

6. A magnetron as claimed in claim 5, wherein the notches in the bottom side have shapes opposite to the top side notches, such that a manner of contact of the inner strap and the outer strap to the odd-numbered anode vanes and the even-numbered anode vanes is opposite.

* * * * *